US011713942B1

(12) United States Patent
Minocha et al.

(10) Patent No.: US 11,713,942 B1
(45) Date of Patent: Aug. 1, 2023

(54) INTELLIGENT ARCHERY RELEASE

(71) Applicants: Saahil Minocha, Hopkinton, MA (US); Himanshu Minocha, Hopkinton, MA (US)

(72) Inventors: Saahil Minocha, Hopkinton, MA (US); Himanshu Minocha, Hopkinton, MA (US)

(73) Assignee: Vipul Minocha, Hopkinton, MA (US)

( * ) Notice: Subject to any disclaimer, the term of this patent is extended or adjusted under 35 U.S.C. 154(b) by 0 days.

(21) Appl. No.: 17/949,773

(22) Filed: Sep. 21, 2022

Related U.S. Application Data

(60) Provisional application No. 63/333,683, filed on Apr. 22, 2022.

(51) Int. Cl.
*F41B 5/18* (2006.01)
*F41B 5/14* (2006.01)

(52) U.S. Cl.
CPC ..... *F41B 5/1469* (2013.01); *F41B 5/1476* (2013.01)

(58) Field of Classification Search
CPC ..... F41B 5/1469
See application file for complete search history.

(56) References Cited

U.S. PATENT DOCUMENTS 5,575,269 A * 11/1996 Harklau ..... F41B 5/1469 124/32
7,086,298 B1 * 8/2006 Colman ..... F41B 5/14 73/862.51
7,337,773 B2 * 3/2008 Simo ..... F41B 5/143 124/44.5
10,852,205 B2 * 12/2020 Dunham ..... G01L 5/04

* cited by examiner

*Primary Examiner* — John A Ricci
(74) *Attorney, Agent, or Firm* — Goodwin Procter LLP

(57) ABSTRACT

An archery release is communicatively coupled to one or more motion sensors to detect the duration from an archer taking an aim up to the release of the arrow, and can measure the archer's unintended, inadvertent movements during this time period, so as to assess the stability of the shot.

24 Claims, 11 Drawing Sheets

INTELLIGENT ARCHERY RELEASE

CROSS-REFERENCE TO RELATED APPLICATIONS

This application claims priority to and benefit of U.S. Provisional Patent Application No. 63/333,683, entitled "Intelligent Archery Release," filed on Apr. 22, 2022, the entire contents of which are incorporated herein by reference.

FIELD OF THE INVENTION

This disclosure generally relates to a release mechanism (also called a release) for a bow used in archery, and in particular, to a release employing one or more sensors for assessing user's movements during the release of a bow.

BACKGROUND

An important part of archery is maintaining consistency and stability while and after taking an aim and until the arrow is released from the bow. A small movement (e.g., on the order of millimeters) from any part of the archer's body can drastically impact where the arrow may land on the target. In one type of archery known as compound archery, the string of a bow is pulled back with a mechanical device, called a release mechanism, or simply a release, that clips onto the string. The release can improve accuracy relative to using just hands to pull back the string. Rather than pulling back a string with hands, an archer wraps his/her/their fingers around the release. To operate a bow with a release, the archer holds the bow with his/her/their non-dominant hand and uses a hook attached to the release to clip onto the string. The archer then uses his/her/their dominant hand to hold onto the release, pulls the string towards the archer, and takes aim.

When the archer is ready to release the arrow, he/she/they push a trigger on the release or tilt it, if the release is triggerless, which opens the hook and allows the string to move forward, thrusting the arrow forward. Given the precise nature of the sport, where the arrow is expected to hit targets the size of a coin from long distances, minor inconsistencies in the archer's form can result in substantial inconsistencies in where the arrows may land on the target. For example, if the archer's hand is an inch or even a fraction of an inch beyond the location up to which where he/she/they would typically pull the string, the arrow would receive extra power, generally causing it to go higher during the flight than it normally would. The extra torque on the hand can slightly extend the length by which the string is pulled, increasing the stretch of the string and adding extra power to the shot. This extra power may cause the arrow to gain extra height in flight and may cause it to miss target.

Pulling the string slightly further back is not the only problem associated with the release of an arrow in archery, however. Many people, especially competitive archers, find that their hands may rotate just about when they are ready to fire the arrow, e.g., a few or tens of milliseconds before the arrow is released. This can affect the follow-through of the shot and it can change the shot angle. With an inconsistent follow-through, the string thrusts the arrow differently on each attempt, making the arrow hits on the target seem random.

Any additional movement in the archer's release hand can also have major consequences regarding the arrow's destination on target. Release mechanisms that are currently available generally do not have any additional mechanism or technology that can measure the stability of the release mechanism during the overall release process, or can convey any movement data to the archer. As such, archers, especially those that lack significant experience, often do not know why the arrow missed an intended spot on the target (or missed the target in some cases). Even when an archer may recognize that some body movement may have resulted in missing the aim, the archer lacks any meaningful information about such movement, so that that movement can be avoided and/or corrected.

SUMMARY

An archery shot process begins with the archer drawing back the string(s) on a bow until the archer's hand typically reaches the side of the archer's face. Once in a comfortable position, the archer aims a particular location on the target (sometimes known as the bull's eye) while attempting to be as stable as possible. Once ready, the archer pushes the trigger on his/her/their release, letting go of the arrow. However, during the process of aiming, there are several factors that the archer needs to be aware of, each of which can impact shot consistency. For example, leaning forward or backward, movement of the release hand (or the non-dominant hand holding the bow), raising one's shoulders independent of their arms, rotating the bow hand, or waiting an extra small amount of time (e.g., a second or two or even a fraction of a second) to shoot, can each introduce shot-to-shot inconsistency.

In order to avoid or mitigate any of the above-described problem(s), a new type of release mechanism is provided. Unlike conventional releases (discussed below), embodiments of the novel release described herein do not employ spring(s). Rather, a guide-rail mechanism is used, making the release less susceptible to any variations that can occur in spring-based releases after several uses. Additionally, embodiments of the novel release can be combined with sensor(s) and analysis technology that can observe and analyzes archer stability throughout the archer's entire shot process. This analysis can inform the archer of his/her/their errors, e.g., inadvertent movements. A quantification of such movements can help the archer minimize such errors, e.g., by adjusting the shot processes, which can result in an improved and/or consistent shot.

Accordingly, in one aspect, a release mechanism (also called a release) for a bow string includes a hook that is movably attached to a housing. The hook is adapted to engage with the bow string. The release also includes a slider having a touch sensor. The slider is adapted to slide within the housing in a first direction. The release additionally includes a peg adapted to slide within the housing in a second direction. The peg may engage with the slider and the hook in a first position of the slider, and may disengage from the slider and the hook in a second position of the slider.

In some embodiments, the release includes an inertial sensor. The inertial sensor may include an accelerometer and/or a gyroscope. The second direction in which the slider may slide may be orthogonal/perpendicular to the first direction in which the slider may slide. The peg may include an opening to receive a portion of the slider when the slider is in the first position. The peg may include a stopper, preventing the peg from falling completely out of the housing.

In another aspect, a method is provided for determining an archer's motion. The method includes detecting using a touch sensor, an archer's contact with a release mechanism (also called a release) attached to a bow string, and recording motion of the archer's hand upon detecting the contact with the release until release (letting go) of the bow string. The motion may be recorded by obtaining an accelerometer reading or a gyroscope reading. For example, recording the motion may include obtaining an accelerometer reading in X, Y, and/or Z directions. Additionally or in the alternative, recording the motion may include obtaining an gyroscope reading in X, Y, and/or Z directions.

In some embodiments, the method includes detecting the release (letting go) of the bow string by comparing an accelerometer reading or a gyroscope reading with a threshold corresponding to a recoil motion of the archer's hand that generally occurs when the bow string is released. The method may include displaying a shot time computed as a difference between a time of the release of the bow string and a time of the contact, and displaying a corresponding score (also called a stability score) based on the recorded motion. The score may include a linear motion score and/or an angular motion score, and/or a composite of the linear and angular motion scores.

In some embodiments, the method includes generating a number of image frames of the archer from a time of the contact and a time of the release of the bow string. The image frames may be generated from a video of the archer captured from a video camera. In these embodiments, the method may include differentiating successive frames to detect motion of the archer, and displaying the detected motion as a gray scale image.

In yet another aspect, a system for providing motion feedback to an archer includes a release mechanism (also called a release) attachable to a bow string. The release includes a touch sensor for detecting activation of the release by an archer, and a first motion sensor for recording motion of the archer's hand. The first motion sensor may be adapted for detecting release (letting go) of the bow string via recoil motion of the archer's hand. The system may include a second motion sensor adapted for detecting release of the bow string via recoil motion of the archer's hand.

In some embodiments, the first motion sensor includes a one dimensional, two dimensional, or a three dimensional accelerometer. Additionally or in the alternative, the first motion sensor may include a one dimensional, two dimensional, or a three dimensional gyroscope. In some embodiments, the system includes a video camera for capturing a video of the archer from a time of detecting the activation of the release and a time of detecting the release (letting go) of the bow string.

In yet another aspect, a system providing motion feedback to an archer includes a first processor, and a first memory in electrical communication with the first processor. The first memory includes instructions that may be executed by a processing unit that may include the first processor or a second processor. The processing unit is in electronic communication with a memory module that may include the first memory or a second memory.

The instructions program the processing unit to receive a touch signal from a touch sensor associated with a release mechanism (also called a release) attachable to a string of a bow, and receive a motion signal from an inertial sensor. In addition, the instructions program the processing unit to compute a score based on, at least in part, one or more stability measures of the motion signal. In some embodiments, the instructions program the processing unit to determine that the motion signal has matched or exceed a recoil motion threshold. In these embodiments, the instructions program the processing unit to compute, as a shot time, a difference between a time at which the motion signal matches or exceeds the recoil threshold and a time at which the touch signal is received.

In some embodiments, the processing unit receives another motion signal from another inertial sensor associated with the archer. In these embodiments, the instructions program the processing unit to determine that the other motion signal has matched or exceed a recoil motion threshold, and to compute, as a shot time, a difference between a time at which the other motion signal matches or exceeds the recoil threshold and a time at which the touch signal is received.

The inertial sensor may include a one, two, or three dimensional accelerometer, or one, two, or three one-dimensional accelerometers. Additionally or in the alternative, the inertial sensor may include a one, two, or three dimensional gyroscope or one, two, or three one-dimensional gyroscopes.

In some embodiments, the instructions program the processing unit to receive a video signal, and select a plurality of frames of the video signal. The plurality of frames are associated with: (i) a base frame corresponding to a time at which the touch signal is received, and (ii) one or more subsequent frames. In these embodiments, the instructions program the processing unit to compute respective differences between one or more subsequent frames and the base frame, and provide the respective differences to a display unit for display. The instructions may program the processing unit to convert the plurality of frames into a corresponding plurality of grayscale frames. The base frame and the subsequent frames may be obtained from the plurality of grayscale frames.

BRIEF DESCRIPTION OF THE DRAWINGS

The present disclosure will become more apparent in view of the attached drawings and accompanying detailed description. The embodiments depicted therein are provided by way of example, not by way of limitation, wherein like reference numerals/labels generally refer to the same or similar elements. In different drawings, the same or similar elements may be referenced using different reference numerals/labels, however. The drawings are not necessarily to scale, emphasis instead being placed upon illustrating aspects of the invention. In the drawings.

DETAILED DESCRIPTION

Figure 1:
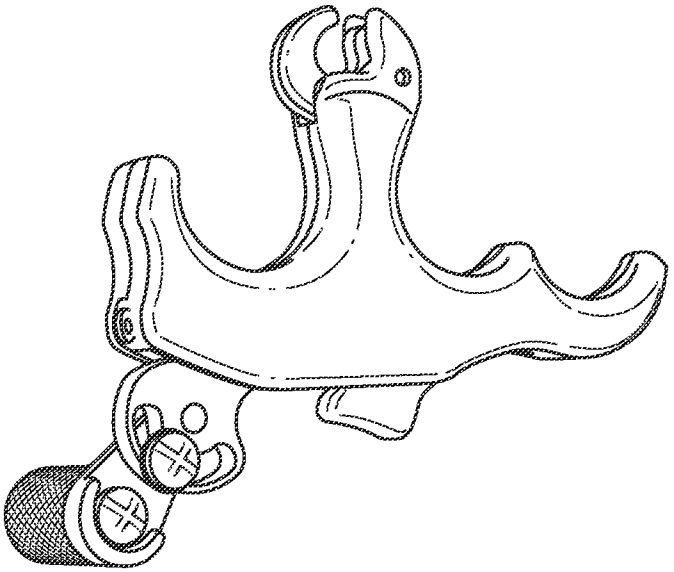
FIG. 1 (PRIOR ART)
FIG. 1 shows a prior art thumb release.

Three types of releases are currently used by archers. These are known as a thumb release, an index-finger release, and a triggerless release (also known as a hinge or back-tension release). FIG. 1 shows a typical thumb release 100, which has a base 102, a hook 104, and a trigger 106, that is activated by the archer's thumb. The bow string is hooked to the hook 104 and is pulled back to take a shot by holding on to the release 100 at the base 102 and by pulling back the release 100. When the archer is ready to fire the arrow, he/she/they may push the trigger 106 with the thumb, which causes the hook 104 to open, releasing the string. An index-finger release generally operates in the same manner, except that the trigger is activated using the index finger. In a triggerless release, the hook can be opened by rotating the release.

These releases generally employ an intricate system of small springs and levers to operate the hook. This can increase the cost of the device and the chances of it breaking upon accidentally being dropped or bumped. It can also decrease the life span of the release because after several (e.g., hundreds or thousands) of uses, the small spring(s) may snaps or lose tension, rendering the release non-functional. Additionally, even if the spring does not break, its tension can change over several uses. This can introduce a variability in the release of the bow string in terms of release time, pressure needed to release the string, etc., which can introduce undesired inconsistencies in the shot.

An Improved Release

Figure 2A:
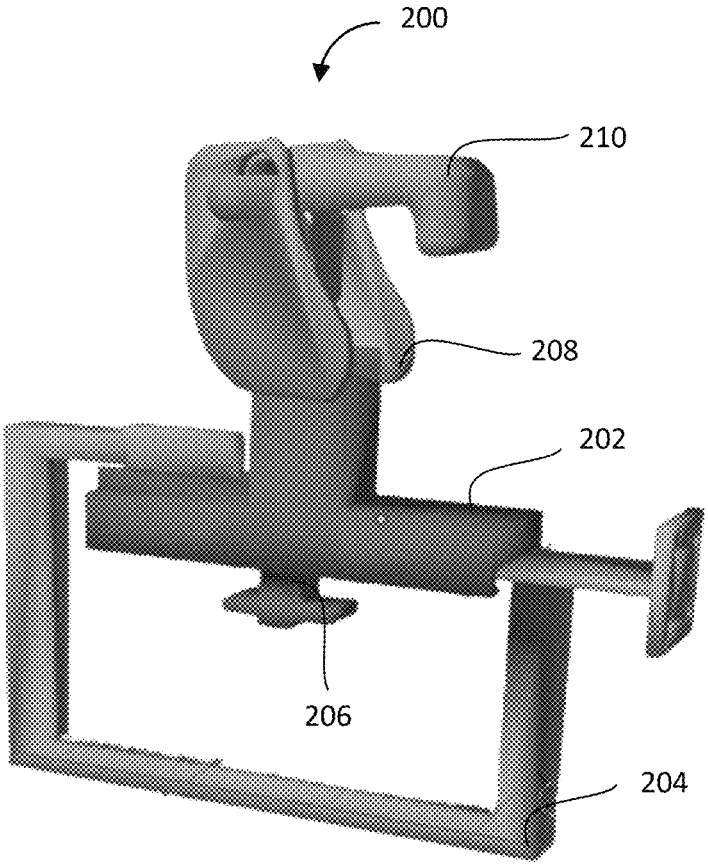
FIGS. 2A-2G depict a novel thumb release and its components, according to various embodiments.

An embodiment of an improved, novel release that avoid springs, and instead uses guide channel or rails, is shown in FIG. 2A. The release 200 includes a housing 202 having a guide channel or rails that allow a slider 204 to move in and out of the housing 202. The housing 202 also houses a peg 206. The slider 204 can only move horizontally within the housing 202 and the peg 206 can only move vertically within the housing 202, as further discussed below. A hook support 208 is mounted on or attached to the housing 202. A hook 210 is held by the hook support 208, and can swing back-and-forth. The hook 210 can engage with the string(s) of a bow. In one position of the hook 210 (referred to as closed position), the hook 210 prevents the string from moving forward on its own accord, so that the string may be held in a stretched position. The hook 210 can swing to another position (referred to as open position), releasing the string, so that it can move forward thrusting the arrow forward.

Figure 2B:
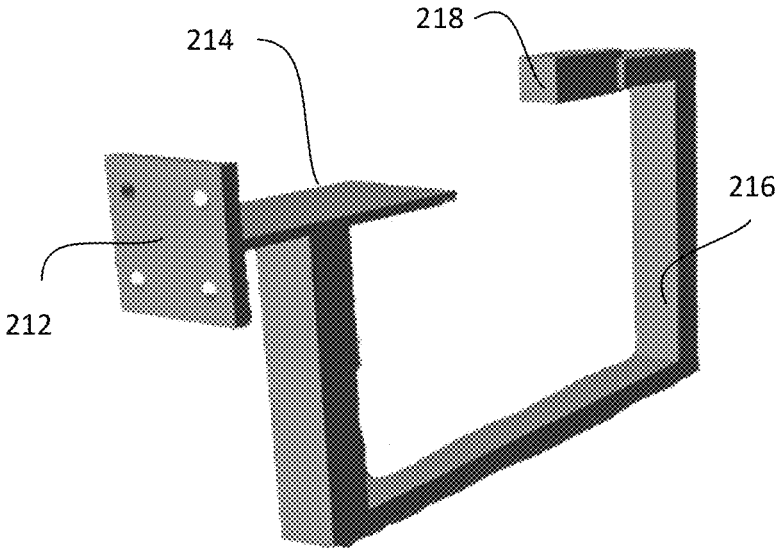

FIG. 2B shows an embodiment of the slider 204. In this embodiment, the slider 204 has a thumb plate 212 and a strip 214 that can slide within the guide channel/rails in the housing 202. A frame 216 is attached to a peg locking portion 218. In some embodiments, a touch sensor (e.g., a capacitive sensor) is mounted on the thumb plate 212. The touch sensor can detect whether an archer is touching the thumb plate 212, where the touch can indicate that the archer is ready to push the slider 204 so that the string would be released.

Figure 2C:
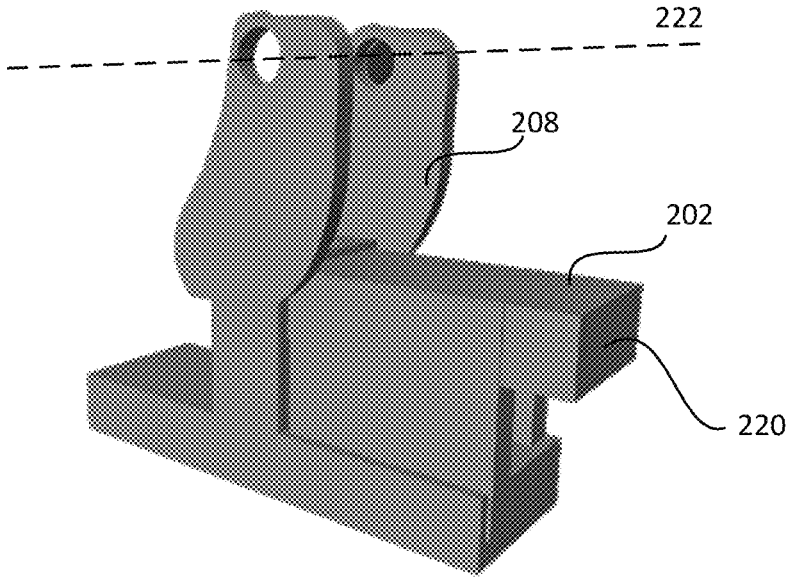

FIG. 2C shows an embodiment of the housing 202. In this embodiment, the housing 202 has a guide channel 220 for receiving the slider 204, e.g., the strip 214 of the slider 202. The guide channel 220 may have a pair of rails on the two sidewalls for guiding the strip 214. The hook support 208 defines an axis of rotation 222 about which the hook 210, when affixed to the hook support 208, can rotate.

Figure 2D:
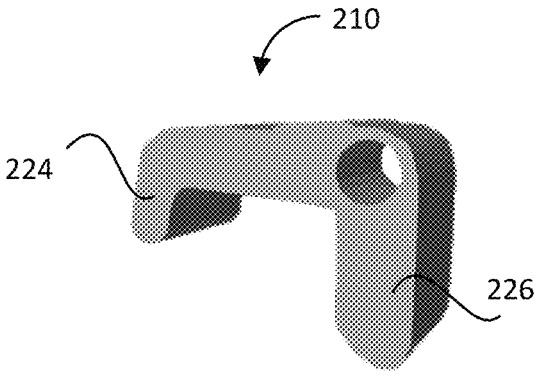

FIG. 2D shows the hook 210 that can be rotatably affixed, e.g., using dowels, to the hook support 208 shown in FIGS. 2A and 2C. The hook 210 has a hook portion 224 whether the bow string(s) can be held and a peg engagement portion 226. The configuration described herein generally allows the hook to rotate about the axis of rotation 222, but substantially prevents the movement of the hook in other directions. This can increase the stability of the string(s) held by the hook 210 and can increase shot consistency.

Figure 2E:
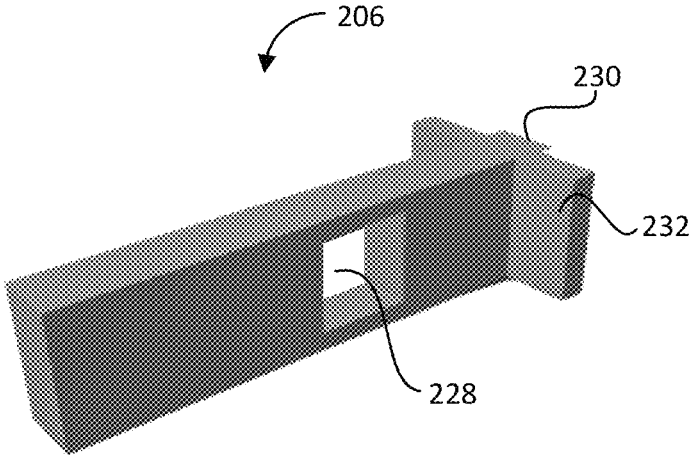

FIG. 2E shows an embodiment of a peg 206. The peg 206 has an opening 228, a head 230, and a stopper 232. The housing 202 has a vertical cavity within which the peg 206 can move vertically. The stopper 232 prevents the peg 206 from falling out of the housing 202. The peg locking portion 218 of the slider 204 (shown in FIG. 2B) can pass through the opening 228. When the peg locking portion 218 and the opening 228 are engaged, the peg 206 is prevented from moving. In this position, the peg head 230 engages with the peg engagement portion 224 of the hook 210, preventing the hook 210 from moving, i.e., swinging or rotating. This causes the string(s) held by the hook portion 224 of the hook 210 to remain in a stretched position while the archer pulls the string further or takes aim.

Figure 2F:
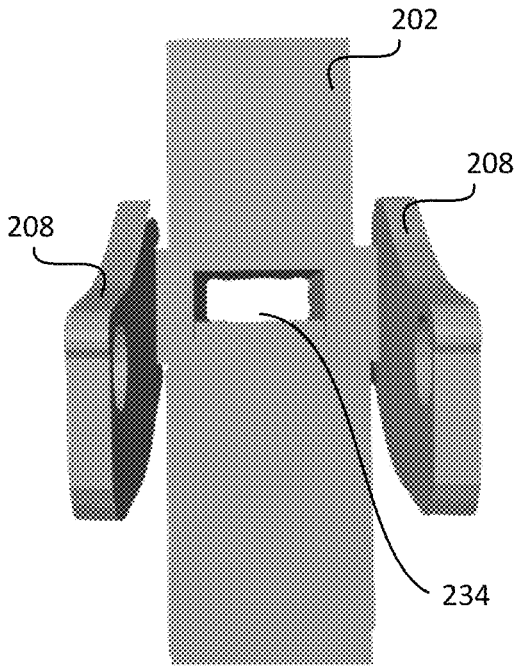
Figure 2G:
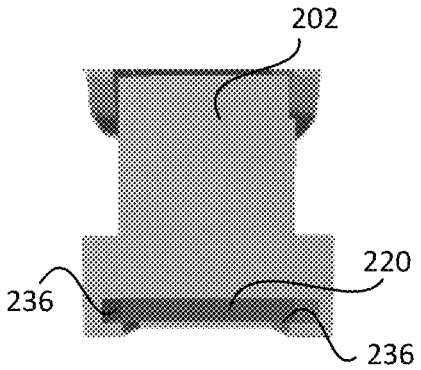

FIG. 2F is an exploded bird's eye view of the housing, where the vertical cavity 234 within which the peg 206 can move is seen. FIG. 2G is a side view of one embodiment of the housing 202. In this embodiment, the guide channel 220 has guide rails 236 along which the strip 214 of the slider 204 can move.

Figure 3A:
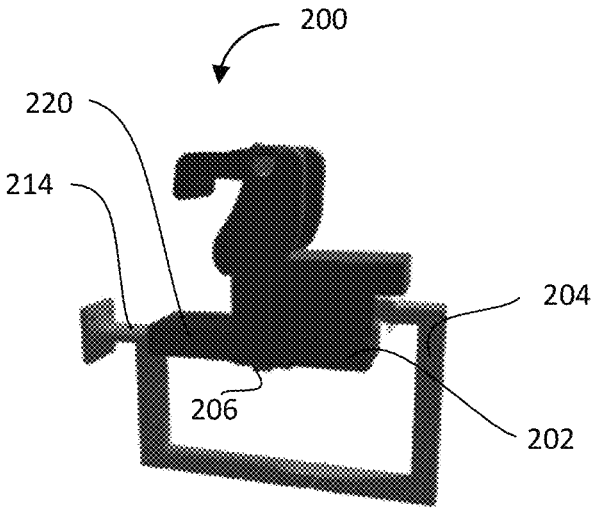
FIGS. 3A and 3B illustrate one aspect of the operational states of a novel thumb release according to one embodiment.
Figure 3B:
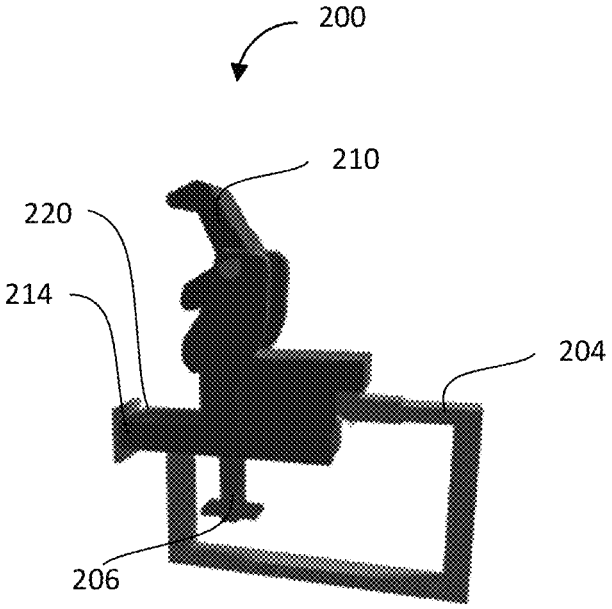

FIGS. 3A and 2B show two different states of the release 200. With reference to FIG. 3A, the slider 204 is not pushed in inside the housing 202, i.e., the slider strip 214 (FIG. 2B) is not pushed inside the guide channel 220 (FIG. 2B). In this position, the peg 206 remains inside the housing 202 and engaged with the slider 214, and the hook 210 remains in the closed position. With reference to FIG. 3B, the slider 204 is pushed in inside the housing 202, i.e., the slider strip 214 (FIG. 2B) is pushed inside the guide channel 220 (FIG. 2B). In this position, the peg 206 drops, and the hook 210 moves to the open position.

Figure 4A:
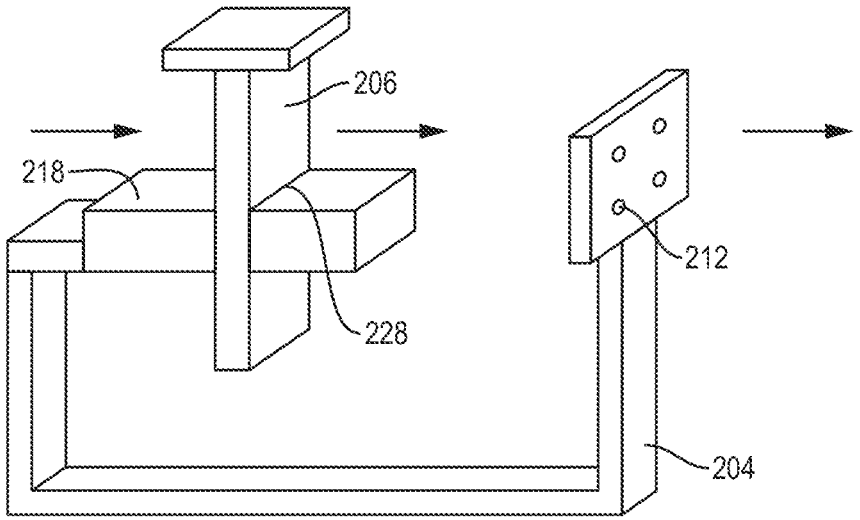
FIGS. 4A and 4B illustrate another aspect of the operational states of a novel thumb release according to one embodiment.

The operation of various embodiments of a release described above is discussed with reference to FIGS. 4A and 4B. FIG. 4A above shows that the slider 204 is engaged with the peg 206, i.e., the thumb plate 212 is not pushed in. Here, the peg locking portion 218 of the slider 204 passes through an opening 228 (see also, FIG. 2E) in the peg 206, preventing the peg from dropping. In this position, the 206 peg prevents the hook (not shown) from moving, so that the string(s) of the bow do not move. In this position, the archer can take aim. In some cases mechanisms other than the opening 228 and/or the peg locking portion 218 may be used to prevent the motion of the peg 206 when the slider 204 is not pushed in. For example, an embodiment of a peg and an embodiment of a slider may be positioned in contact with each other so that the friction between the two prevents the peg from falling. In some cases, small magnets may be mounted on embodiments of a slider and a peg, locking the peg in place when the slider is not pushed in.

Figure 4B:
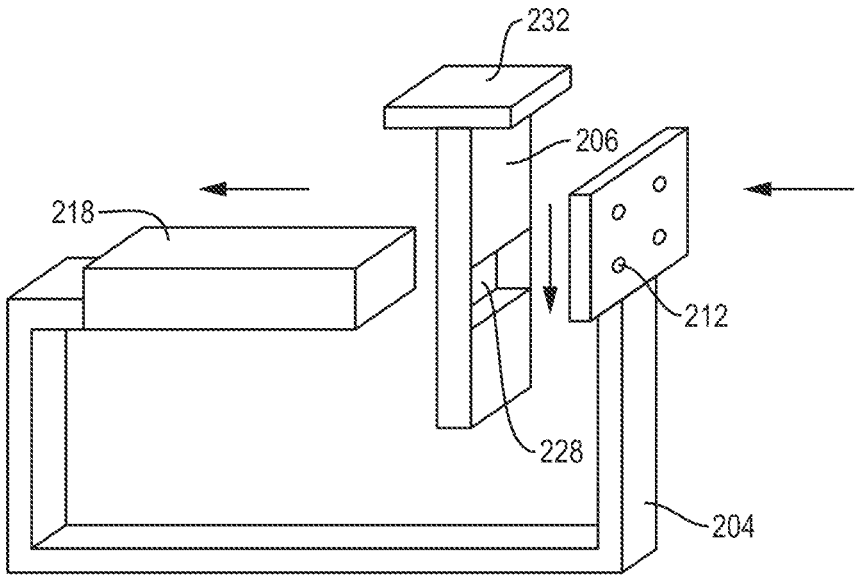

Referring to FIG. 4B, after the archer has taken aim, the archer may touch the thumb plate 212 of the slider 204 and may begin to push the slider 204 within a guide channel of a housing not shown in FIG. 4B. As the slider 204 is pushed, at a certain time, the peg locking portion 218 moves completely out of the opening 228 in the peg 206. At that instant, the peg 206 begins to fall due to gravity, and as the peg 206 falls, it no longer prevents the hook (not shown) from moving. The hook swings or rotates due to the design of its mounting and the tension in the bow string(s), and when the hook swings, the string(s) of the bow can move forward, thrusting the arrow forward.

A structure, such as a stopper 232 (see also, FIG. 2E) is provided at one end of the peg 206, which prevents the peg 206 from falling completely out of the housing. In some cases, other mechanisms, such as a tapered peg, having a wider top, or a peg attached to the housing using a string or a spring, may be used to prevent the peg from falling completely out of the housing. A spring can provide an additional downward force to the peg as it begins to fall down, allowing for a faster release of the hook. A spring is not necessary, however, as the peg 206 can fall quickly enough under gravity.

For the next shot, the archer may push the peg 206 up and may pull the slider 204 out, so that the slider 204, via the peg locking portion 218 engages with the peg 206 as shown in FIG. 4A, preventing the peg 206 from falling down until the slider 204 is pushed in again.

Components for Data Collection and Feedback

Embodiments of the improved, novel release that are described above are beneficial because they avoid intricate configurations of springs and other components. As such, various embodiments of the improved, novel release can be cost effecting and/or more durable. The benefits of the release described above can be enhanced further using components for data collection and analysis that can provide feedback to an archer, as discussed below. This can help improve shot stability and consistency.

Figure 5:
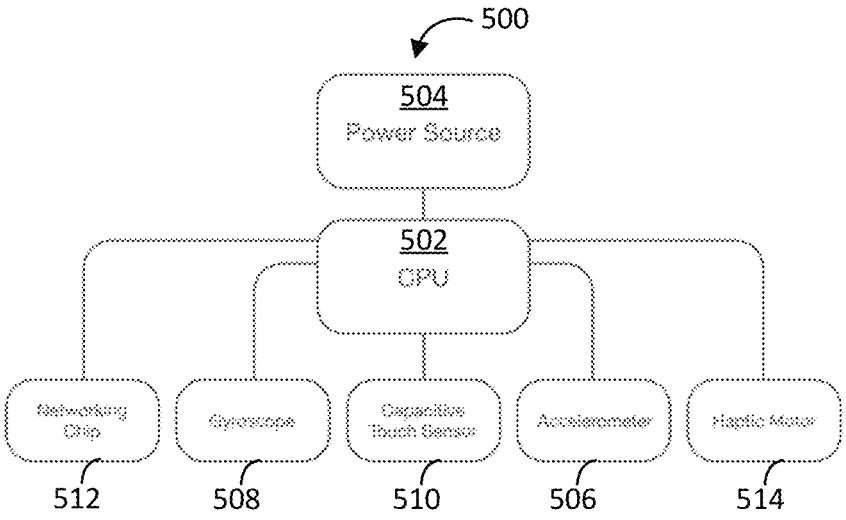
FIG. 5 schematically depicts an electronic system coupled to a novel release, according to one embodiment.

With reference to FIG. 5, in some embodiments the release includes an electronic system 500 having a processor/CPU 502. The CPU 502 can be powered by any suitable power source 504, such as wall socket, USB, or a battery. The electronic system 500 also includes one or more sensors such as an accelerometer 506, a gyroscope 508, and a touch sensor 510. The sensors 506-510 can communicate with the CPU 502 via a networking chip/component 512. The communication can be wired or wireless. The electronic system 500 may also include a haptic motor 514.

A significant source of errors and inconsistencies in different shots by an archer is the inadvertent movement of the arms and/or body by the archer during a short time period before the arrow is released. In particular, the relevant time period is from the instance of time at which the archer determines that he/she/they have taken aim and a subsequent instance of time at which the arrow begins to move forward in response to its release by the archer. These movements can be captured by the accelerometer 506. The accelerometer 506 can be a single, two, or three-axis accelerometer, or may include one, two, or three accelerometers, to measure linear motion in one, two, or three dimensions. While the accelerometer 506 can measure linear motion(s), the gyroscope 508 can capture angular (rotational motions). The gyroscope 508 can also be a single, two, or three-axis gyroscope, or may include one, two, or three gyroscopes, to measure angular motion in one, two, or three dimensions.

By measuring linear and/or angular motion in three dimensions, feedback on the archer's inadvertent hand motions, that include up/down, left/right, forward/backward, and rolling motions, can be generated. Such feedback can revel shot inconsistencies that may be imperceptible to the human eye or to a trained coach. While a three-dimensional linear and angular motion feedback can be comprehensive, feedback on the hand motion(s) in only two or in just a single dimension, and/or using only an accelerometer, can also be helpful in understanding shot inconsistencies. An unintentional hand movement in a particular way, even a fraction of a second before the shot, can significantly affect the thrust imparted to the arrow and/or its angle, which can affect the shot accuracy. Using the feedback described above, the archer can avoid or mitigate the detected inadvertent hand motion(s), which can improve shot consistency and accuracy.

The mechanics of an archery shot are such that a shot generally begins with intended motion by the archer, in the drawing the string(s) of the bow using the dominant hand, and in adjusting the bow using the non-dominant hand, to take an aim. In moments before a shot, however, once the archer has determined that he/she/they have taken aim, the archer generally attempts to remain still, except undertaking any motion to release the arrow. In case of a thumb release, where the traditional one (see FIG. 1), or according to the various embodiments described herein (see, e.g., FIG. 2A), that intended motion typically includes nothing more than pressing the thumb.

It is this short time period, from the instance of time (referred to as the shot-start time/instance) at which the archer determines that he/she/they have taken aim and a subsequent instance of time (referred to as the shot-completion time/instance) at which the arrow begins to move forward in response to its release by the archer, where any unintended motion of the archer's hands and/or body can inadvertently change the aim. The time period between the shot-start time/instance and the shot-completion time/instance may be referred to as the recording period. Sensor data recorded during a particular recording period immediately preceding a particular shot can indicate any inadvertent movements associated with that shot.

In various embodiments, the shot-start time/instance is identified by observing that the archer has placed his/her/their thumb on the thumb plate 212 (FIG. 2B). This observation can be made using the touch sensor 510. The touch sensor 510 can be a capacitive touch sensor mounted to the thumb plate 212. Once the slider 202 (FIG. 2A) is pushed in to the point at which the peg locking portion 218 (FIG. 2B) no longer engages with the opening 228 in the peg 206 (FIG. 2E), the peg 206 begins to drop. At this time, as discussed, e.g., with reference to FIG. 4B, the hook 210 rotates and no longer restrains the bow string(s), which begin to move forward, thrusting the arrow towards the target. At this time instance, which is the shot-completion time/instance, the dominant hand pulling on the release 200 and the bow string(s) generally recoils. That recoil action can be detected by the accelerometer 506, as a sudden large acceleration. The acceleration is normalized to a value of zero upon the archer placing his/her/their thumb on the thumb plate 212 (FIG. 2B). Any motion detected afterward is generally directly proportional to the changes in acceleration in the coordinate directions X, Y, and Z directions, and the acceleration values are typically provided by the accelerometer.

Like the touch sensor 510, the motion sensors, e.g., the accelerometer 506 and/or the gyroscope 508 can be mounted to (or within) the release 200. Alternatively, the motion sensors can be worn by the archer, e.g., on or within a wrist band, in a hand glove, etc. While understanding the inadvertent motion of the dominant arm during the recording period is important to improving shot stability, consistency, and accuracy, the inadvertent motion of other body parts, such as the non-dominant arm holding the bow, the shoulders, head, etc., can also impact the shot. Such motion can be observed and measured using one or more cameras. The camera(s) can be placed near the archer or an in-built camera in computer that has the CPU 502, or in another computer, can be used.

Figure 6A:
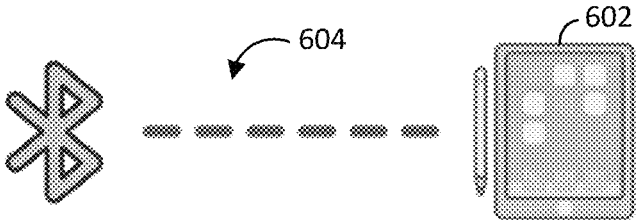
FIGS. 6A and 6B schematically depict electronic communication between sensor(s) and camera(s) used with a novel release and a computer used for analyzing sensor data, according to different embodiments.
Figure 6B:
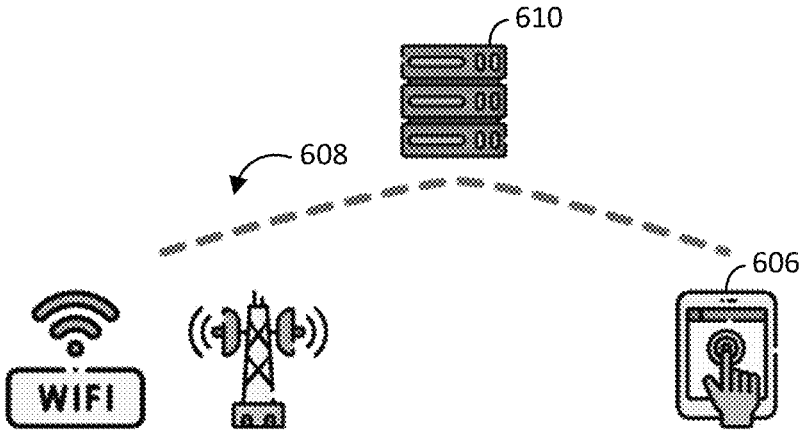

FIGS. 6A and 6B illustrate different ways in which the data collected by the touch sensor and motion sensor(s), and the optional camera(s) (collectively, data-collection devices) may be received by a processing computer for analyzing such data. In some embodiments, the processing computer is a computer that includes the CPU 502. For example, the CPU 502 may be a processor included in a desktop or laptop computer, a smart-phone, or a tablet computer. In other cases, the processing computer is different from the computer having the CPU 502. The processing computer may receive the data from the data-collection devices in real time.

Referring to FIG. 6A, one or more data-collection device(s) are connected to the processing computer 602 is via a local network 604, such as a Bluetooth™ network. Referring to FIG. 6B, one or more data-collection device(s) are connected to the processing computer 606 via a network 608 and a server 610. The network 608 may include a local network, e.g., a WiFi network, and a proprietary or public network, e.g., the Internet. In this case, the CPU 502 may be used to transmit the collected data to the server 610. The processing computer 602 or 606 runs one or more software modules to analyze the received data. The data analysis may be presented by the processing computer and/or the computer having the CPU 502 (if that computer is different from the processing computer).

Data Analysis

As discussed above, a respective recording period is associated with each shot. An archer session can be a time period during which the archer attempts several (e.g., 5, 10, 100, etc.) shots. Data collected in several recording periods within a session may be received by the processing computer in real-time, or at scheduled intervals. Different data transmissions in a session may include different types/amounts of information. In some cases, at least a subset of data transmission in a session includes the same type and amount of information, so that the information can be analyzed over a sequence of recording periods. A transmission corresponding to a particular recording period typically includes the shot-start time/instance, the shot-completion time/instance, the accelerometer readings in the X, Y, and Z dimensions, and the gyroscope readings in the X, Y, and Z dimensions. The transmission may also include video frames captured by the camera(s) during the recording period. Additionally, the touch sensor reading may also be transmitted, which can be used to determine whether the archer's thumb remained on the thumb plate 212 (FIG. 2B) throughout the recording period.

The processing computer analyzes the received data, and the results of the analysis may be displayed to the archer, a coach, or another user using a presentation computer. The presentation computer can be the computer having the CPU 502 (FIG. 5) or it could be another computer. The analysis is performed on a per recording period basis and may also be performed across different, e.g., successive, recording periods.

Figure 7:
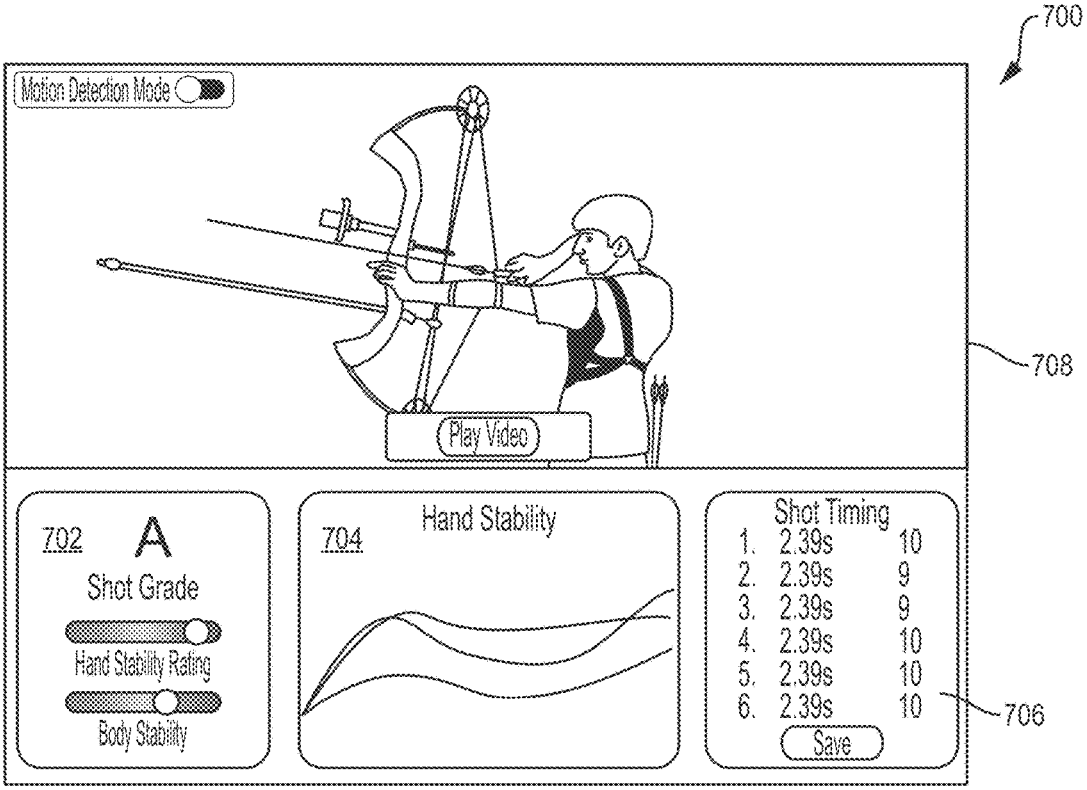
FIG. 7 shows an example presentation of the analysis of the data collected by sensor(s) and/or camera(s) associated with a novel release.

With reference to FIG. 7, an example presentation 700 includes a shot grade panel 702. The shot grade can be a letter grade or a numerical score. The shot grade may also include a hand stability rating and a body stability rating. The shot grade is determined by comparing the movement of the archer against a base near-zero movement. This near-zero movement is defined as the archer's movement not exceeding a threshold specified for the accelerometer 506 for a specified time (e.g., a few milliseconds). A near-zero movement is used as a reference because it is likely infeasible for an archer to remain perfectly motionless during a particular recording period. In general, the shot grade does not indicate how good the shot was. Rather, the shot grade reflects how close the archer was to having the arrow fly towards its intended location.

The presentation 700 also includes a hand stability panel 704 displaying a hand stability graph that shows the archer's movement on each axis throughout the entire shot process, i.e., the recording period corresponding to a shot. This helps visualize if the archer loses stability near during the shot process. If it is seen that the movement increases towards the end of the shot process, this indicates that the archer may be holding on to the arrow for too long, increasing his/her/their fatigue.

In addition, the presentation 700 includes a shot timing panel 706 listing the respective lengths of the last N recording periods, where N is a number such as 3, 6, 10, 20, etc. Since the recording period is defined by the shot-start time/instance and shot-completion time/instance, this listing shows for how long the archer holds on to the string(s) for each shot. The listing also includes a corresponding shot score, which allows the archer to determine which shot time may yield the best results.

The analysis by the processing computer may include analyzing image data received from one or more cameras. The image data can be a sequence of still images taken at rapid intervals during the recording time. The stills are referred to herein as frames. The stills may be captured at a frequency of 30 frames per second, but higher or lower frequency rates are also contemplated. In some cases, the image data can be a video stream, from which frames can be selected at specified intervals. The frames are converted to grayscale, and the pixel-by-pixel differences in the respective pixel colors from the first frame in the recording period (referred to as the initial frame) and a later frame are visualized. This can show the parts of the body that are not stable.

In general, the more the body moves during a recording period, the more the difference between the initial frame and a later frame. A frame buffer holding up to F frames is provided, where F can be any number such as 4, 10, 15, etc. This allows a comparison between several pairs of frames, which can detect movements across a number of frames. The larger movements that are detected may be exaggerated (e.g., displayed with a greater intensity) in the visualization. This generally allows the archer or another user to know whether the archer's shoulders are unstable, or whether the archer's non-dominant hand holding the bow hand is less stable, and to what degree. The per-pixel comparison of frames allows the detection of even very small movements.

In some embodiments, the difference is compared to a selectable tolerance threshold, and only those differences that are greater than (or are at least equal to) the selected tolerance threshold are visualized. This allows a calibration of the visual feedback, where certain inadvertent but unavoidable movement may be excluded. In addition to visualizing the frame-to-frame, pixel-by-pixel difference, the difference may be used to compute a body stability score that may be displayed in the shot grade panel 702 of the presentation 700. In some embodiments, the presentation 700 includes a video panel 708 that can display the archer's action during a corresponding recording period.

Figure 8:
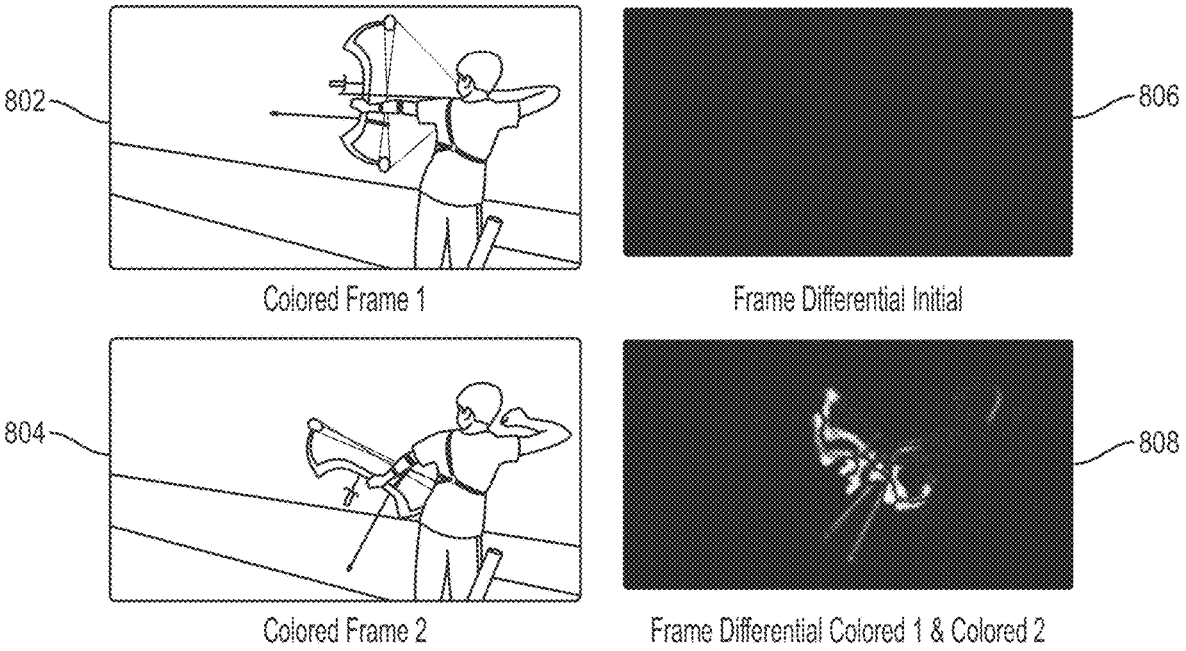
FIG. 8 shows body-movement visualization, according to one embodiment.

FIG. 8 illustrates visualization of the body movement discussed above. In FIG. 8, two color frames 802 and 804, that are obtained from a video captured by a camera during a recording period are shown. The frame 802 corresponds to the shot-start time/instance, and frame 804 corresponds to a later time/instance within the recording period. Additional intermediate frames are also obtained from the captured video but are not shown. Image 806 shows the pixel-by-pixel greyscale difference between a frame before the frame 804 and the frame 802. Image 808 shows the pixel-by-pixel greyscale difference between the frames 804 and 802.

The generally black image 806 indicates that the earlier frame difference did not detect substantial body movement. As the body of the archer moves later, the difference computation detects such difference, as indicated by the image 808. In the image 808, the parts of the body that moved significantly are indicated by the grey/white pixels. In general, the greater the movement, the lighter are the corresponding pixels in the difference image. For example, it can be seen in frames 802 and 804 that the archer's right elbow moved somewhat, which is indicated by the region 810 in the image 808. From the frames 802 and 804 it can also be seen that the archer's left hand (the non-dominant hand) and the bow moved substantially. This movement is indicated by the region 812 in the image 808. Such a presentation can provide visual feedback on any inadvertent body movements occurring during a shot process.

Figure 9A:
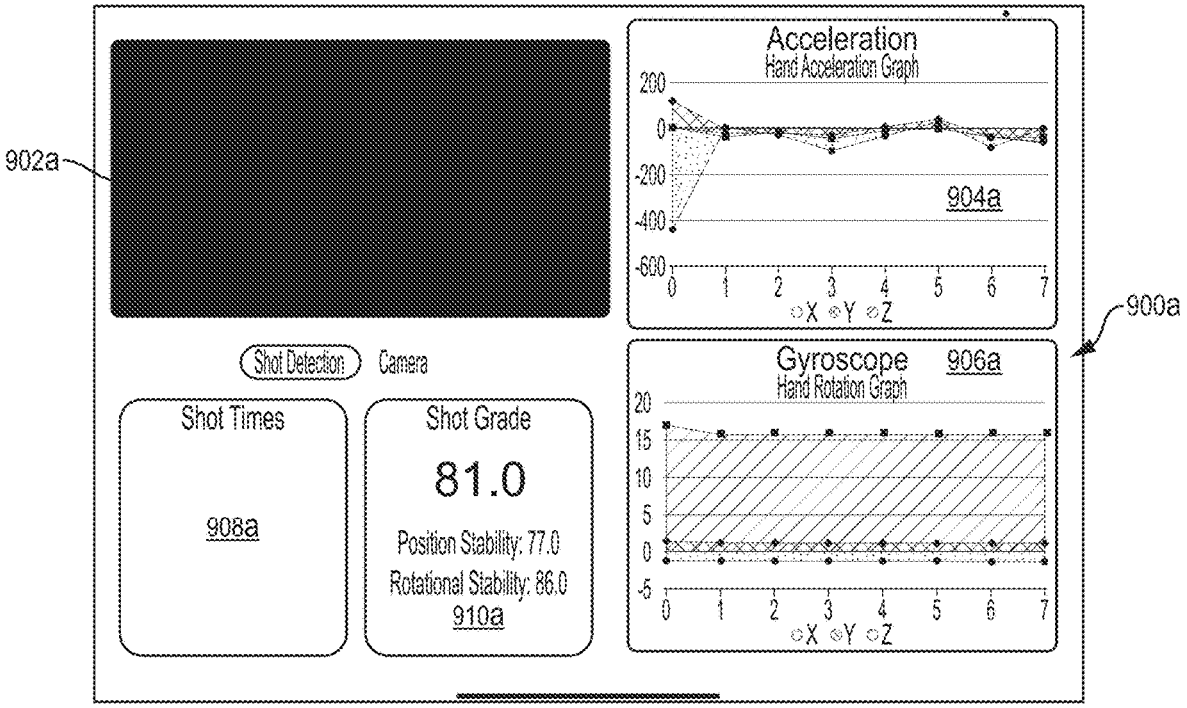
FIGS. 9A and 9B show another example presentation of the analysis of the data collected by sensor(s) and/or camera(s) associated with a novel release.
Figure 9B:
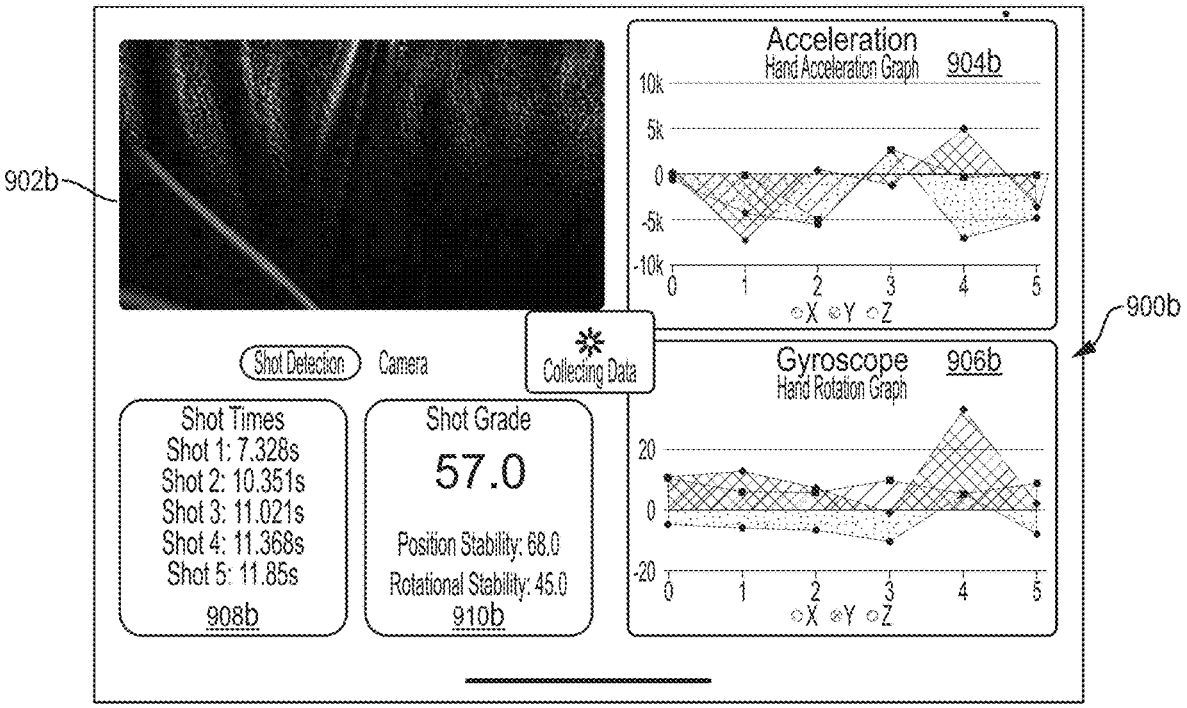

FIGS. 9A and 9B show another example of presentation of the archer's motion. The presentation 900*a* shown in FIG. 9A includes a panel 902*a* that shows body movement during a particular recording period. The panel 902*a* indicates that there was no substantial body movement during that particular recording period. Panels 904*a* and 906*a* show, respectively, the accelerometer and gyroscope readings in the X, Y, and Z dimensions, during the particular recording period. These readings indicate the inadvertent movement of the dominant arm during the shot process. Panel 908*a* shows the shot time for the shot, along with the respective shot times for a certain number (e.g., 3, 5, 10, etc.) of previously taken shots. Panel 910*a* shows the overall shot grade, a position stability score obtained from the accelerometer readings and indicating inadvertent linear movement, and a rotational stability score obtained from the gyroscope readings and indicating inadvertent rotational movement.

FIG. 9B shows the presentation 900*b*, which includes the corresponding panels 902*b*-910*b* for a different shot process by the same archer and the corresponding recording period. The panels 902*b* indicates significant body movement and panels 904*b* and 906*b* indicate substantial movement of the dominant arm during the recording period. In general, a more stable shot receives a higher grade and stability scores, and the corresponding accelerometer and gyroscope graphs shown in panels 904 and 904 are relatively flatter.

In some embodiments, a computing system can provide motion feedback to an archer. The computing system includes a first processor, and a first memory in electrical communication with the first processor. The first memory also includes instructions that may be executed by a processing unit. The processing unit can be, or include, the first processor, or can be or include a different, second processor. For example, the first processor can be a server, and computing unit and the second processor may be included in a laptop, tablet computer, or a smart phone that may download the instructions from the server. The processing unit is in electronic communication with a memory module that may include the first memory or may include a different, second memory. Via the instructions in the first memory, the processing unit is programmed to perform various operations and computations.

Specifically, the processing unit may receive a touch signal from a touch sensor associated with a release attachable to a string of a bow. The programming unit may also receive a motion signal from one or more inertial sensors, for example, from an inertial sensor mounted on or within the release, and/or from an inertial sensor worn by an archer, e.g., on a wrist of the archer's dominant hand. The processing unit may compute a score based on, at least in part, a comparison of the motion signal with one or more thresholds.

The processing unit may determine that the motion signal has matched or exceed a specified recoil motion threshold, and record the time (also called recoil time) at which this condition occurred. The processing unit may then compute a shot time as a difference between the time at which the motion signal matches or exceeds the recoil threshold and a time at which the touch signal is received.

In one embodiment, discussed further below, the inertial sensor includes a three dimensional accelerometer, and a three dimensional gyroscope, where the dimensions are designated X, Y, and Z. Other embodiments may include only an accelerometer or only a gyroscope, where the accelerometer or the gyroscope may be one, two, or three dimensional. Yet other embodiments may include both an accelerometer and a gyroscope, but the accelerometer and/or the gyroscope is not three dimensional, and may be one or two-dimensional. In some other embodiments, instead of using two or three dimensional accelerometers and/or gyroscopes, two or three accelerometers and/or gyroscopes, mounted along respective axes, are used. The computations discussed below for the embodiment using a three-dimensional accelerometer and a three dimensional gyroscope can be adapted for the other embodiments discussed above.

For the embodiment using a three-dimensional accelerometer (referred to as the 3D accelerometer) and a three dimensional gyroscope (referred to as the 3D gyroscope), three sets (also called sequences) of linear motion readings are obtained from the 3D accelerometer, where the three sets correspond to the X, Y, and Z dimensions, respectively. Three sets of angular (also called rotational) motion readings, respectively corresponding to the X, Y, and Z dimensions, are obtained from the 3D gyroscope. In this embodiment, the motion signal includes three linear motion signals for the three dimensions and three angular motion signals for the three dimensions. The three linear motion signals and the three angular motion signals are recorded from the time at which the touch signal is received and the recoil time. The six sets of readings described above are obtained from the three linear motion signals and the three angular motion signals, e.g., by periodic sampling of the respective signals.

A linear motion stability measure for the set of linear motion readings for the X-dimension is computed. The stability measure can be a statistical measure, e.g., variance, or an aggregate of respective differences relative to a X-dimension linear motion threshold or baseline value. Respective linear motion stability measures for the Y and Z dimensions are also computed. In addition, three angular motion stability measures are computed using the three sets of angular motion readings. A composite linear motion measure/score may be computed by aggregating the three linear motion stability measures. Likewise, a composite angular motion measure/score may be computed by aggregating the three angular motion stability measures. Moreover, a composite score may be computed by aggregating the composite linear motion measure/score and the composite angular motion measure/score. The aggregation can be a unweighted or weighted sum, where the weights for the respective sets may depend on the readings in those sets.

It is described above that the shot-start time/instance can be detected using a touch sensor in the release. In addition, or alternatively, the shot-start time/instance can be detected using an accelerometer mounted on or within the slider of the release. The shot-completion time/instance is generally marked by the recoil movement of the archer's hand that typically occurs when the arrow is released. It is described above that the recoil movement may be recorded by an accelerometer associated with the archer's dominant hand. Alternatively, or in addition, the gyroscope associated with the archer's dominant hand may be used to detect the shot-completion time/instance. In some embodiments, an additional touch sensor can be attached to the release that is activated when the slider moves to a position at which it no longer holds the peg, causing the peg to begin to fall, which subsequently causes the release of the arrow. The shot-completion time/instance can also be detected by mounting on or within the peg a motion sensor (e.g., another accelerometer) that can detect the downward fall of the peg, which subsequently causes the release of the arrow.

The above described data collection, analysis, and presentation provides a visual and/or quantitative feedback to an archer about his/her/their shot process. In some cases, a haptic motor 514 (FIG. 5) can provide physical feedback to the archer. In general, the detected inadvertent movement of the dominant hand can be analyzed to identify a significant defect in the on-going shot process, where this condition is indicated to the archer by the haptic motor. For example, if the shot is too high (or too low), as indicated by the movement of the archer's dominant hand, the motor may tap the archer's wrist of the dominant hand once (or twice), lightly. If the archer's dominant hand has moved/rotated significantly left or right, the haptic motor may tap the archer's wrist of the dominant hand three times, lightly.

If the non-dominant hand movement is off to the left (or right) the haptic motor may heavily tap the wrist once (or twice). If the non-dominant hand movement is off on any other axis the haptic motor may tap the wrist three times. This physical feedback can immediately inform archers on the quality of their shot without having to check a companion app and/or visual presentation, allowing the archer to make real-time adjustments to the shot. The presentation discussed above can help a user (e.g., an archer or a coach) understand the shot process in details after one or more shots are completed.

In some cases, the software module performing the analysis described above is adapted to recalibrate the sensors to be within their designated tolerance prior to use. This will ensure that all the data is normalized and can be compared session to session. This calibration is necessary to maintain consistent performance for each sensor. This allows for the training tool to be used over extended periods of time and the archer can track their progress quantitatively over a long window of time without fear of data degradation.

In general, there is an ideal timing for a high quality shot. Shooting too quickly likely means aiming and precision were compromised. Waiting too long can cause fatigue which can cause the bow to drop or to lose stability. Therefore, there is an ideal range of timing for an archer where a balance of precision and fatigue can be reached. Having a consistently timed shot can improve consistency and accuracy on the target. The data collection and analysis discussed herein may allow a user (an archer or a coach) to determine an ideal timing range for a particular archer. The individual linear movement stability, rotational stability, and body stability scores and shot timing, and a composite score/grade can be used to give the archer both a quantitative score and qualitative feedback, which may allow the archer to make adjustments to his/her/their shot process. This feedback may also help determine the user objectively whether any adjustments made are better or worse, so that further adjustments, as needed, can be made.

Typically, an archer may not want to practice with a different release from the one he/she/they use in a tournament, because switching any equipment can change how the archer shoots and corrects any errors. Especially on a competition day, anything unfamiliar can result in lost points or uncomfortable adjustments. To avoid this, many archers use the same equipment for both practicing and in competitions. While the sensors described above can be integrated with a release, as also described above, the sensors (except for the touch sensor) can be physically detached from the release. The touch sensor can also be detached from the thumb plate of a slider of the release. As such, the archer is not forced to use one release for practicing and another one for the competition.

Moreover, the touch sensor can be attached to the thumb plate of another release and the touch sensor and the other sensors, and the optional camera(s) are electronically coupled to the computer(s) collecting, analyzing, and presenting the sensor (and image) data. As such an archer can easily substitute one release for another, if needed, and can receive the feedback discussed above.

Archery is a sport of repeating the same actions as closely as physically possible. Inconsistency does occur however, so that it is desirable that each factor that may unintentionally change the arrow's destination be isolated and corrected. Various embodiments discussed above present to the archer and/or a coach the specific data on stability and movement throughout the shot process. As such, the archer is informed of the corrections that need to be made to his/her/their shot process. Conversely, if certain stability and movement aspects are rated highly (e.g., the stability and movement of a particular arm or those along a particular axis), the archer may focus on other inadvertent movements and may consider other aspects of the shot process. This can avoid unnecessary changes to aspects of the shot process that need not be changed, and allow the archer to focus on aspects that may be beneficially changed.

It is clear that there are many ways to configure the device and/or system components, interfaces, communication links, and methods described herein. The disclosed methods, devices, and systems can be deployed on convenient processor platforms, including network servers, personal and portable computers, and/or other processing platforms. Other platforms can be contemplated as processing capabilities improve, including personal digital assistants, computerized watches, cellular phones and/or other portable devices. The disclosed methods and systems can be integrated with known network management systems and methods. The disclosed methods and systems can operate as an SNMP agent, and can be configured with the IP address of a remote machine running a conformant management platform. Therefore, the scope of the disclosed methods and systems are not limited by the examples given herein, but can include the full scope of the claims and their legal equivalents.

The methods, devices, and systems described herein are not limited to a particular hardware or software configuration, and may find applicability in many computing or processing environments. The methods, devices, and systems can be implemented in hardware or software, or a combination of hardware and software. The methods, devices, and systems can be implemented in one or more computer programs, where a computer program can be understood to include one or more processor executable instructions. The computer program(s) can execute on one or more programmable processing elements or machines, and can be stored on one or more storage medium readable by the processor (including volatile and non-volatile memory and/or storage elements), one or more input devices, and/or one or more output devices. The processing elements/machines thus can access one or more input devices to obtain input data, and can access one or more output devices to communicate output data. The input and/or output devices can include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processing element as provided herein, where such aforementioned examples are not exhaustive, and are for illustration and not limitation.

The computer program(s) can be implemented using one or more high level procedural or object-oriented programming languages to communicate with a computer system; however, the program(s) can be implemented in assembly or machine language, if desired. The language can be compiled or interpreted. Sets and subsets, in general, include one or more members.

As provided herein, the processor(s) and/or processing elements can thus be embedded in one or more devices that can be operated independently or together in a networked environment, where the network can include, for example, a Local Area Network (LAN), wide area network (WAN), and/or can include an intranet and/or the Internet and/or another network. The network(s) can be wired or wireless or a combination thereof and can use one or more communication protocols to facilitate communication between the different processors/processing elements. The processors can be configured for distributed processing and can utilize, in some embodiments, a client-server model as needed. Accordingly, the methods, devices, and systems can utilize multiple processors and/or processor devices, and the processor/processing element instructions can be divided amongst such single or multiple processor/devices/processing elements.

The device(s) or computer systems that integrate with the processor(s)/processing element(s) can include, for example, a personal computer(s), workstation (e.g., Dell, HP), personal digital assistant (PDA), handheld device such as cellular telephone, laptop, handheld, or another device capable of being integrated with a processor(s) that can operate as provided herein. Accordingly, the devices provided herein are not exhaustive and are provided for illustration and not limitation.

References to "a processor", or "a processing element," "the processor," and "the processing element" can be understood to include one or more microprocessors that can communicate in a stand-alone and/or a distributed environment(s), and can thus can be configured to communicate via wired or wireless communication with other processors, where such one or more processor can be configured to operate on one or more processor/processing elements-controlled devices that can be similar or different devices. Use of such "microprocessor," "processor," or "processing element" terminology can thus also be understood to include a central processing unit, an arithmetic logic unit, an application-specific integrated circuit (IC), and/or a task engine, with such examples provided for illustration and not limitation.

Furthermore, references to memory, unless otherwise specified, can include one or more processor-readable and accessible memory elements and/or components that can be internal to the processor-controlled device, external to the processor-controlled device, and/or can be accessed via a wired or wireless network using a variety of communication protocols, and unless otherwise specified, can be arranged to include a combination of external and internal memory devices, where such memory can be contiguous and/or partitioned based on the application. For example, the memory can be a flash drive, a computer disc, CD/DVD, distributed memory, etc. References to structures include links, queues, graphs, trees, and such structures are provided for illustration and not limitation. References herein to instructions or executable instructions, in accordance with the above, can be understood to include programmable hardware.

Although the methods and systems have been described relative to specific embodiments thereof, they are not so limited. As such, many modifications and variations may become apparent in light of the above teachings. Many additional changes in the details, materials, and arrangement of parts, herein described and illustrated, can be made by those skilled in the art. Accordingly, it will be understood that the methods, devices, and systems provided herein are not to be limited to the embodiments disclosed herein, can include practices otherwise than specifically described, and are to be interpreted as broadly as allowed under the law.

What is claimed is:

1. A release for a bow string, the release comprising:

a hook movably attached to a housing, the hook being adapted to engage with the bow string;

a slider comprising a touch sensor, the slider being adapted to slide within the housing in a first direction; and a peg adapted to slide within the housing in a second direction, and to engage with the slider and the hook in a first position of the slider and to disengage from the slider and the hook in a second position of the slider.

2. The release of claim 1, comprising an inertial sensor.

3. The release of claim 2, wherein the inertial sensor comprises an accelerometer or a gyroscope.

4. The release of claim 1, wherein the second direction is orthogonal to the first direction.

5. The release of claim 1, wherein the peg comprises an opening to receive a portion of the slider when the slider is in the first position.

6. The release of claim 1, wherein the peg comprises a stopper, preventing the peg from falling completely out of the housing.

7. A method for determining an archer's motion, the method comprising:

detecting using a touch sensor, an archer's contact with a release attached to a bow string;

recording motion of the archer's hand upon detecting the contact until release of the bow string, recording the motion comprising obtaining an accelerometer reading or a gyroscope reading.

8. The method of claim 7, wherein recording the motion comprises obtaining an accelerometer reading in X, Y, or Z directions.

9. The method of claim 7, wherein recording the motion comprises obtaining an gyroscope reading in X, Y, or Z directions.

10. The method of claim 7, further comprising:

detecting the release of the bow string by comparing the accelerometer reading or the gyroscope reading with a threshold.

11. The method of claim 7, further comprising:

displaying a shot time computed as a difference between a time of the release of the bow string and a time of the contact; and displaying a corresponding score based on the recorded motion.

12. The method of claim 7, further comprising:

generating a plurality of image frames of the archer from a time of the contact and a time of the release of the bow string;

differentiating successive frames to detect motion of the archer; and displaying the detected motion as a gray scale image.

13. A system for providing motion feedback to an archer, the system comprising:

a release attachable to a bow string, the release comprising a touch sensor for detecting activation of the release by an archer; and a first motion sensor for recording motion of the archer's hand.

14. The system of claim 13, wherein the first motion sensor is adapted for detecting release of the bow string via recoil motion of the archer's hand.

15. The system of claim 13, further comprising a second motion sensor adapted for detecting release of the bow string via recoil motion of the archer's hand.

16. The system of claim 13, wherein the first motion sensor comprises a one dimensional, two dimensional, or a three dimensional accelerometer.

17. The system of claim 13, wherein the first motion sensor comprises a one dimensional, two dimensional, or a three dimensional gyroscope.

18. The system of claim 13, further comprising a video camera for capturing a video of the archer from a time of detecting the activation of the release and a time of detecting the release of the bow string.

19. A system providing motion feedback to an archer, the system comprising:

a first processor; and a first memory in electrical communication with the first processor, and comprising instructions that, when executed by a processing unit that comprises the first processor or a second processor, and wherein the processing unit is in electronic communication with a memory module that comprises the first memory or a second memory, program the processing unit to:

receive a touch signal from a touch sensor associated with a release attachable to a string of a bow;

receive a motion signal from an inertial sensor; and compute a score based on, at least in part, one or more stability measures of the motion signal.

20. The system of claim 19, wherein the instructions program the processing unit to:

determine that the motion signal has matched or exceed a recoil motion threshold; and compute, as a shot time, a difference between a time at which the motion signal matches or exceeds the recoil threshold and a time at which the touch signal is received.

21. The system of claim 19, wherein the inertial sensor comprises a one, two, or three dimensional accelerometer.

22. The system of claim 19, wherein the inertial sensor comprises a one, two, or three dimensional gyroscope.

23. The system of claim 19, wherein the instructions program the processing unit to:

receive a video signal;

select a plurality of frames of the video signal, the plurality of frames being associated with: (i) a base frame corresponding to a time at which the touch signal is received, and (ii) one or more subsequent frames;

compute respective differences between one or more subsequent frames and the base frame; and provide the respective differences to a display unit for display.

24. The system of claim 23, wherein the instructions program the processing unit to:

convert the plurality of frames into a corresponding plurality of grayscale frames, wherein the base frame and the subsequent frames are obtained from the plurality of grayscale frames.

* * * * *